US005984105A

United States Patent [19]

Lease et al.

[11] Patent Number: 5,984,105

[45] Date of Patent: Nov. 16, 1999

[54] MATERIAL CLASSIFYING APPARATUS

[75] Inventors: Daniel T. Lease, McHenry; Steve Massman, Hoffman Estates; Steven C. Wiechmann, Sleepy Hollow, all of Ill.

[73] Assignee: General Kinematics Corporation, Barrington, Ill.

[21] Appl. No.: 09/089,614

[22] Filed: Jun. 3, 1998

[51] Int. Cl.[6] ..... B07B 9/00

[52] U.S. Cl. ..... 209/37; 209/139.1; 209/142; 209/147

[58] Field of Search ..... 209/30, 36, 37, 209/139.1, 138, 142, 146, 147, 920

[56] References Cited

U.S. PATENT DOCUMENTS 2,815,858 12/1957 Rich ..... 209/138
5,348,161 9/1994 Mueller ..... 209/139.1 X

*Primary Examiner*—David H. Bollinger
*Attorney, Agent, or Firm*—Marshall, O'Toole, Gerstein, Murray & Borun

[57] ABSTRACT

In order to separate two classifiable materials, a material classifying apparatus includes a vibratory conveyor for conveying a fluidizable material from a material to be separated therefrom from an inlet end through a material separation section to an outlet end located downstream of the material separation section. A plenum chamber directs air upwardly through the fluidizable material and the material to be separated therefrom in the material separation section of the vibratory conveyor to cause fluidization of the fluidizable material and separation of the material to be separated therefrom by forming the material separation section to include a fluidizing deck for supporting the two classifiable materials while accommodating passage of air upwardly from the plenum chamber therethrough. With this arrangement and construction, the upper surface of the fluidizing deck has fluidizing zones for stabilizing the fluidizable material on the fluidizing deck to produce a uniform airflow through the fluidizable material to facilitate separation of the material to be separated therefrom upstream of the outlet end of the vibratory conveyor.

20 Claims, 7 Drawing Sheets

MATERIAL CLASSIFYING APPARATUS

FIELD OF THE INVENTION

The present invention is generally directed to a material classifying apparatus and, more particularly, a classifying apparatus for separating two classifiable materials.

BACKGROUND OF THE INVENTION

In many industrial applications, it is necessary and/or desirable to be able to separate two classifiable materials that have become or are naturally commingled.

As one example, a material may be utilized in an application such that it becomes contaminated but is otherwise reusable if it can be reclaimed. It is known that in almost all commercial settings it is important to economize in order to maintain competitive costs and, additionally, it is equally important to limit commercial waste that often presents significant expensive disposal problems. For these reasons, there have been significant efforts to develop techniques for reclaiming and/or separating materials in a cost effective and efficient manner.

For certain applications, there is a need to separate a heavier material from fines that are lighter in weight. This typically cannot be accomplished by utilizing an elementary technique such as screening inasmuch as the fines are commonly interspersed throughout the heavier material and, due to their lighter weight, the fines will not settle to the level of the screen to pass through leaving only the heavier material. As a result, it is recognized that applications of this type require techniques that are far more sophisticated.

Despite this recognition, it is also recognized that the competing considerations of cost and overall effectiveness are of paramount importance. It is likewise often a key factor that the technique for separation and recovery of classifiable materials be sufficiently effective to handle the volume of combined materials that are typically encountered in any particular industrial application(s). In other words, the technique must be capable of separating and recovering classifiable materials in a time frame compatible with the industrial application(s).

As one example, shot is utilized in the manufacture of castings to finish the castings by subjecting them to a shot blast treatment. This finishing technique is highly effective but, by its very nature, produces refuse in the form of fines and dust that must be separated from the shot if it is to be suitable for reuse. Still additionally, the large volume of shot that is required for shot blast treatments means that a significant volume of material must be reclaimed.

In order to achieve the reclamation of the shot as a reusable material in a timely manner, it is necessary to separate and remove the fines as a waste product in a high volume operation.

The present invention is directed to overcoming one or more of the foregoing problems and achieving one or more of the resulting objects.

SUMMARY OF THE INVENTION

Accordingly, it is a principal object of the present invention to provide an apparatus for the classification of materials that are generally of a non-homogenous nature. It is a further object of the present invention to provide a material classifying apparatus for separating a lighter material from a heavier material. Additionally, it is an object of the present invention to provide an apparatus for separating fines from shot by utilizing a fluidizing deck as a portion of a vibratory conveyor.

To achieve these objects, the present invention comprises a material classifying apparatus which includes a vibratory conveyor having a fluidizing deck together with means for stabilizing a fluidized material on the fluidizing deck. The vibratory conveyor is suited for conveying two classifiable materials in the form of the fluidized material and another material to be separated therefrom from an inlet end through a material separation section to an outlet end located downstream of the material separation section. A plenum chamber directs air upwardly through the fluidized material and the other of the materials in the material separation section of the vibratory conveyor to cause fluidization of the fluidized material and separation of the other of the materials therefrom. The material separation section of the vibratory conveyor includes the fluidizing deck which supports the two classifiable materials including the fluidized material and the other of the materials to be separated therefrom while accommodating the passage of air upwardly from the plenum chamber through the fluidized material. Still additionally, the fluidized material stabilizing means serves to produce a uniform air flow through the fluidized material to facilitate separation of the other of the materials from the fluidized material upstream of the outlet end of the vibratory conveyor.

In the exemplary embodiment, the plenum chamber and the material separation section define a portion of a closed loop air circulation system and the apparatus includes means for isolating the material separation section from the remainder of the vibratory conveyor to maintain a desired air pressure within the closed loop air circulation system. The fluidizing deck advantageously has a plurality of air passageways within the closed loop air circulation system to permit air to continuously flow from the plenum chamber through the air passageways in the fluidizing deck and back to the plenum chamber to fluidize the fluidized material which may comprise a material and separate the other of the materials which may comprise fines therefrom. The stabilizing means advantageously comprises a grate suitably disposed on an upper surface of the fluidizing deck and formed of at least a plurality of material retention walls extending generally across the material separation section in spaced relation to define a plurality of stable fluidizing zones. Preferably, the material classifying apparatus also includes an exhaust hood above the material separation section which, together with the plenum chamber, forms a portion of the closed loop air circulation system for fluidizing the material and separating the fines from the material for removal through the exhaust hood.

In a highly preferred embodiment, the vibratory conveyor also includes a screen section upstream of the material separation section having a mesh size to permit the material and fines to pass from a first level of the vibratory conveyor through the screen to a second, lower level while retaining any overs material larger than the material at the first level. For this purpose, an overs material diverting wall is advantageously provided downstream of the screen section of the vibratory conveyor at the first level and upstream of the material separation section to cause overs material to be diverted from the vibratory conveyor to a collection box alongside the vibratory conveyor.

In another respect, the closed loop air circulation system includes not only an exhaust hood above the material separation section of the vibratory conveyor but also means defining a continuous air flow path from the exhaust hood to the plenum chamber and means for removing the fines along the continuous air flow path at a point upstream of the plenum chamber. The continuous air flow path is advantageously defined by an air duct flexibly connected to the exhaust hood and extending therefrom together with an air duct extending toward the plenum chamber and flexibly connected thereto, and an air blower is advantageously provided for circulating air from the exhaust hood to the plenum chamber through these air ducts. As for the refuse material removing means, it advantageously includes a cyclone separator positioned downstream of the exhaust hood for removing the fines and a dust collector positioned downstream of the cyclone separator for removing dust at a point upstream of the plenum chamber.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
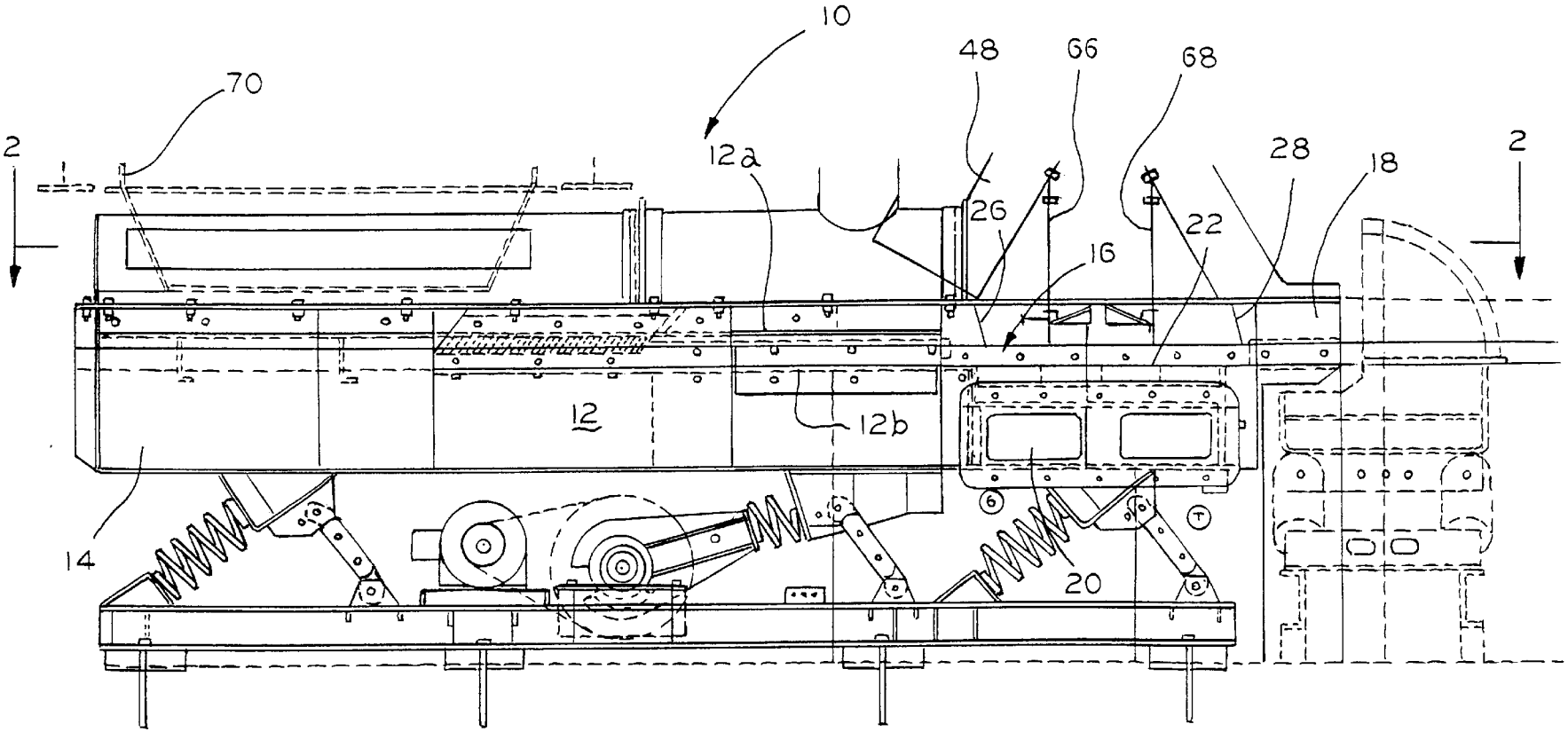
FIG. 1 is a side elevational view, partially in section, of a portion of the material classifying apparatus of the present invention.

In the illustrations given, and with reference first to FIG. 1, the reference numeral 10 designates generally a material classifying apparatus in accordance with the present invention. The apparatus 10 includes a vibratory conveyor generally designated 12 for conveying two classifiable materials which may comprise a heavier material and fines from an inlet end 14 through a material separation section 16 to an outlet end 18 located downstream of the material separation section 16 of the vibratory conveyor 12. A plenum chamber 20 directs air upwardly through the heavier material and the fines in the material separation section 16 of the vibratory conveyor 12 to cause fluidization of the heavier material and separation of the fines therefrom. The material classifying apparatus 10 is formed such that the material separation section 16 of the vibratory conveyor 12 comprises a fluidizing deck 22 for supporting the heavier material and the fines while accommodating passage of air upwardly from the plenum chamber 20 through the heavier material. With this arrangement, the apparatus 10 further includes means for stabilizing the heavier material on the fluidizing deck 22 to produce a uniform air flow through the heavier material to facilitate separation of the fines from the heavier material upstream of the outlet end 18 of the vibratory conveyor 12.

Figure 6:
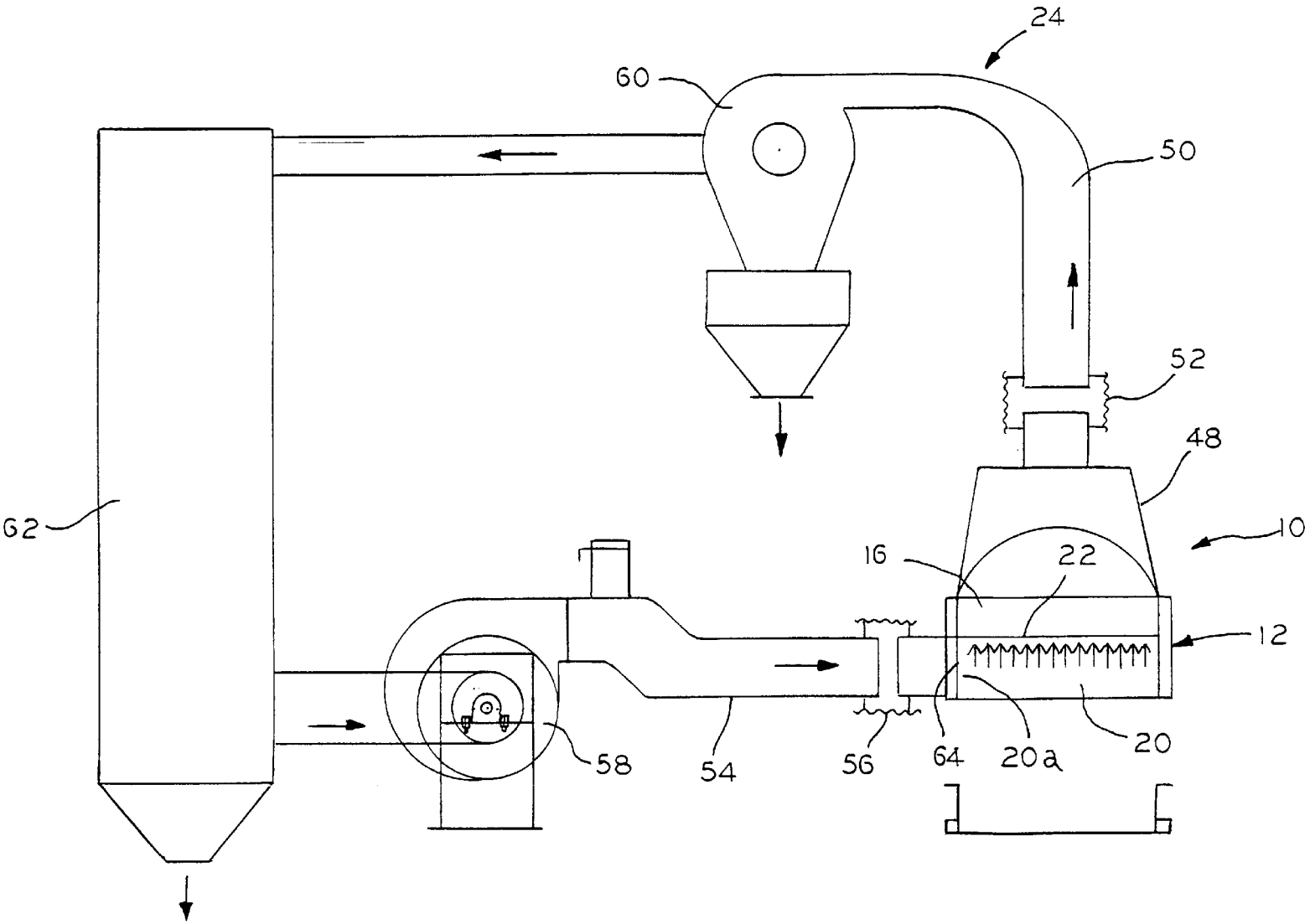
FIG. 6 is a schematic view illustrating the closed loop air circulation system of the material classifying apparatus of FIG. 1.
Figure 7:
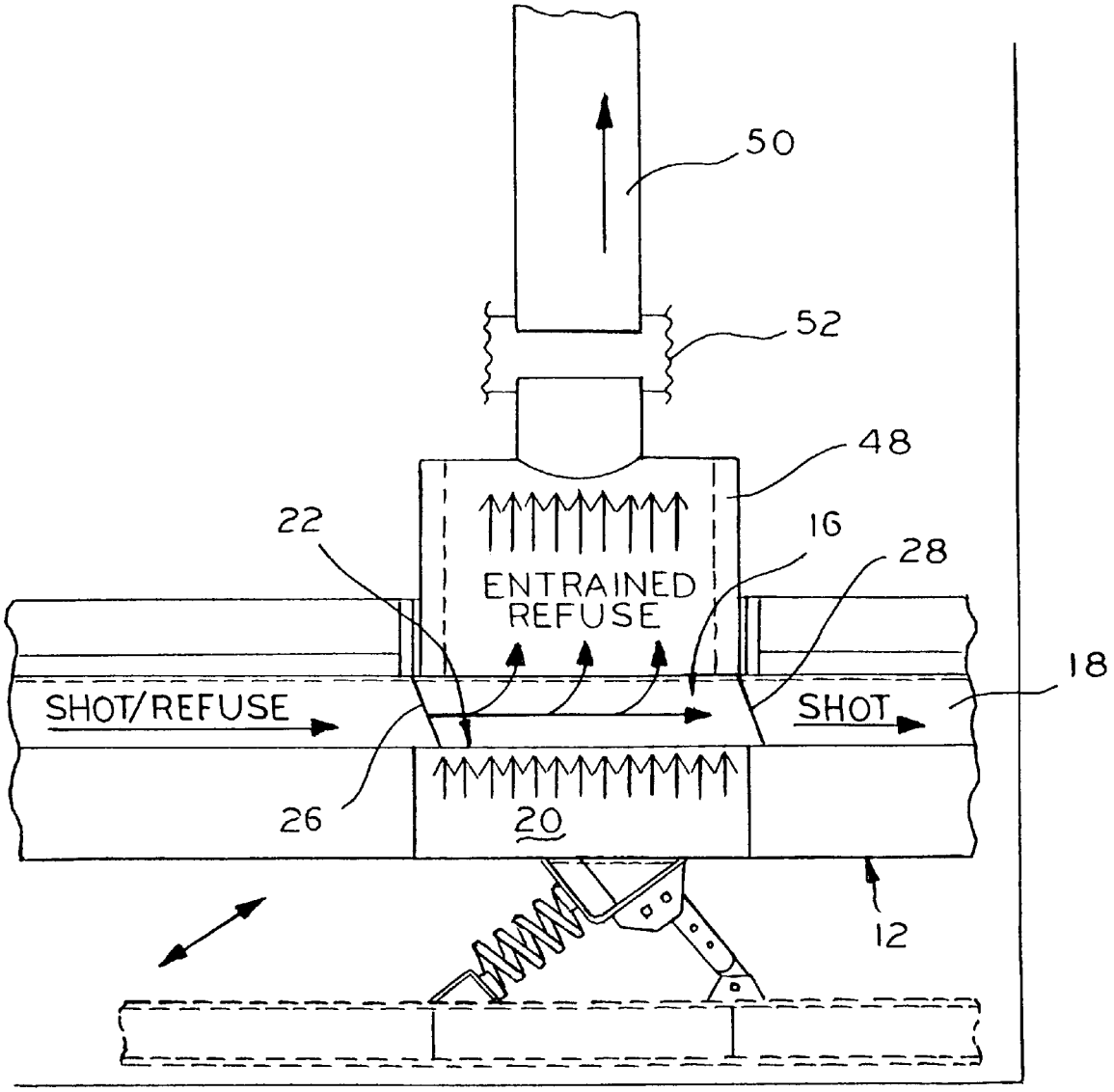
FIG. 7 is a cross-sectional view taken generally along the line 7—7 of FIG. 6.

In accordance with the present invention, and referring now to FIGS. 1, 6, and 7, the plenum chamber 20 and the material separation section 16 define a portion of a closed loop air circulation system which is generally designated 24. The apparatus 10 also includes means for isolating the material separation section 16 from the remainder of the vibratory conveyor 12, such as flexible flap seals 26 and 28, to maintain a desired air pressure within the closed loop air circulation system 24. As will be appreciated, the flexible flap seals 26 and 28 engage the heavier material and lighter fines that are being conveyed by the vibratory conveyor 12 at both an upstream end 16*a* and downstream end 16*b* of the material separation section 16, respectively.

Figure 3:
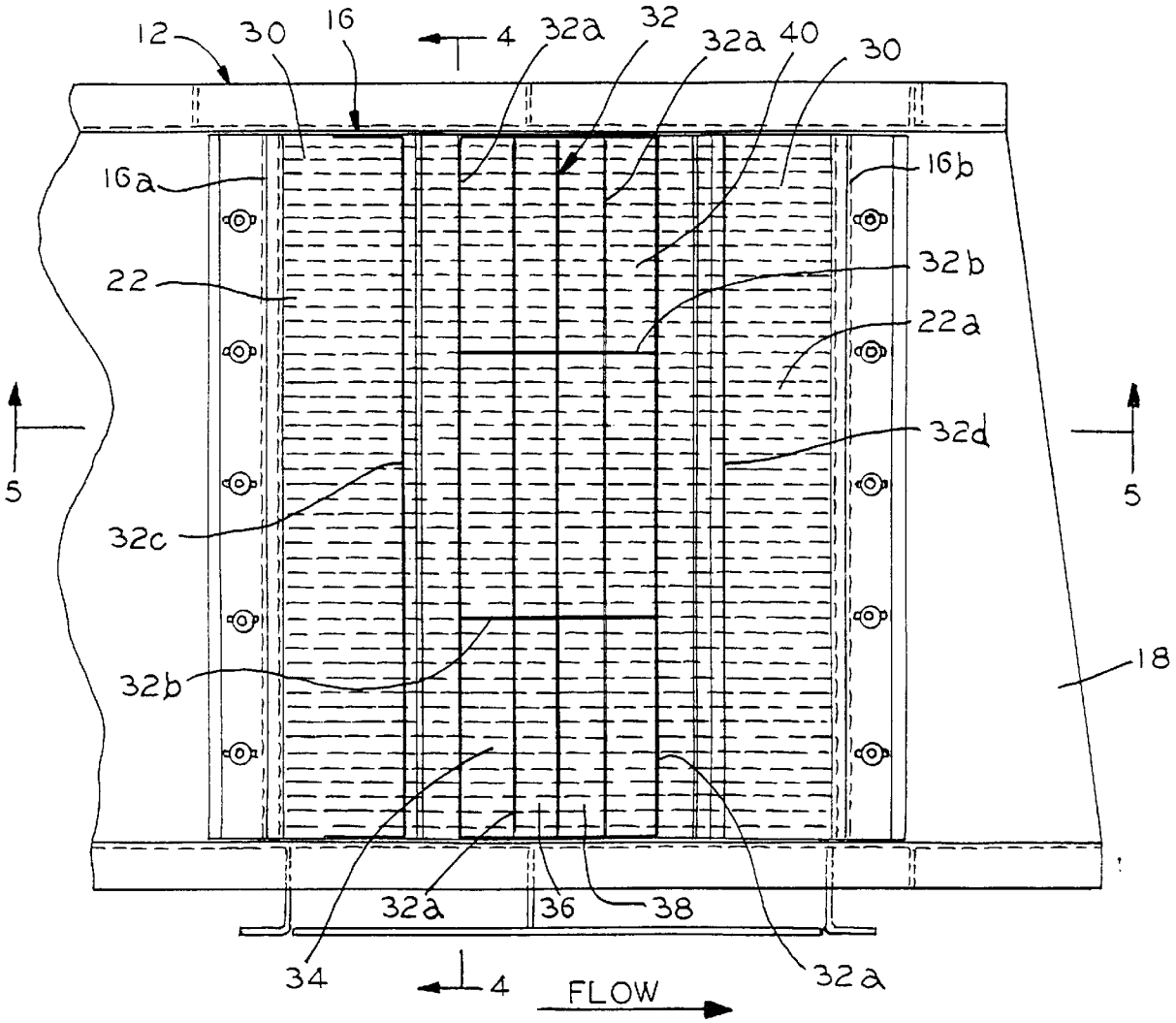
FIG. 3 is a plan view of the material separation section of the material classifying apparatus of FIG. 1.

As best shown in FIG. 3, the fluidizing deck 22 has a plurality of air passageways 30 within the closed loop air circulation system 24 and, by comparing FIGS. 3, 6 and 7, the position of the fluidizing deck 22 within the closed loop air circulation system 24 will be understood. With this arrangement, it will be appreciated that air is permitted to continuously flow from the plenum chamber 20 through the air passageways 30 in the fluidizing deck 22 and back to the plenum chamber 20 to continuously fluidize the heavier material and separate the lighter fines therefrom.

Figure 4:
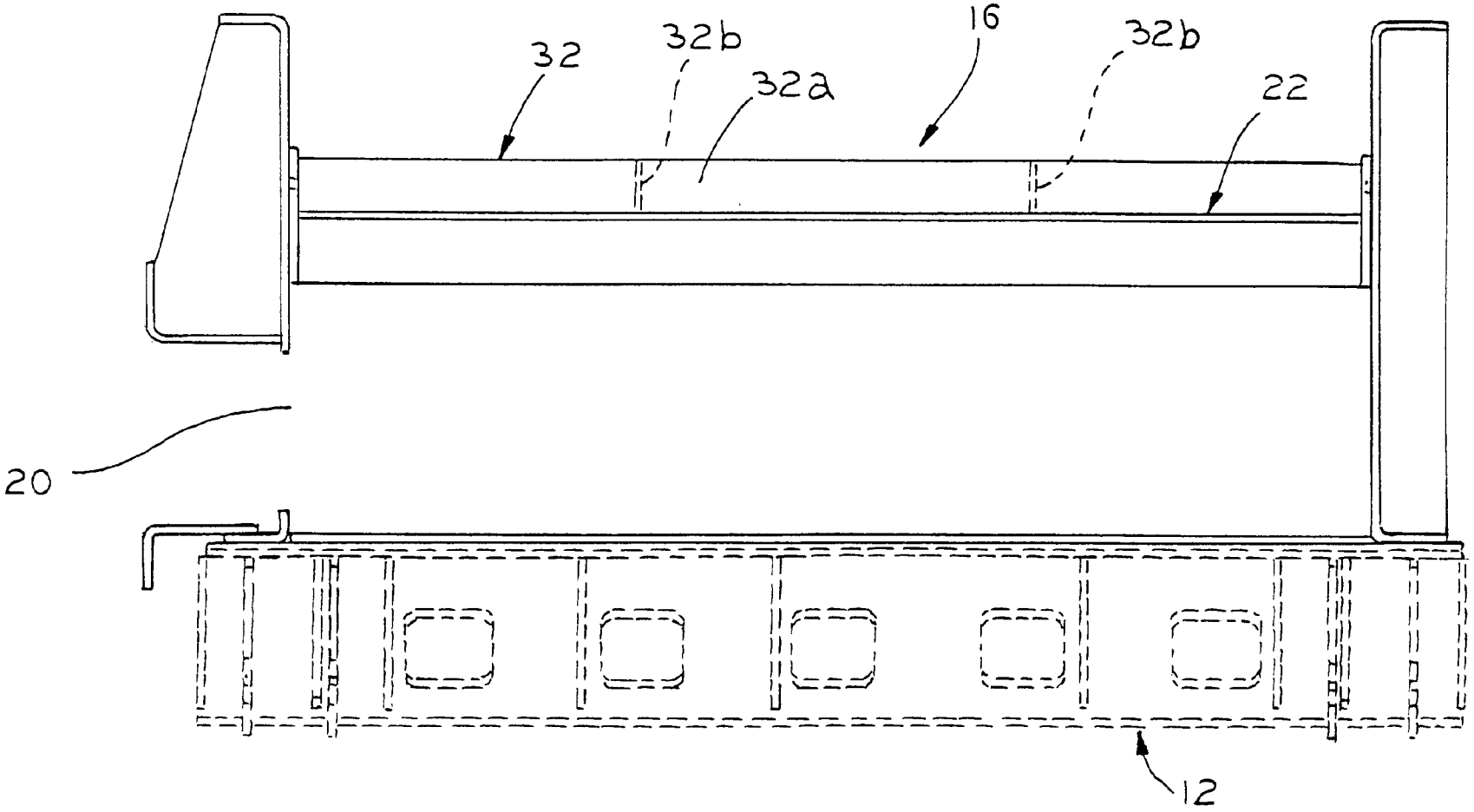
FIG. 4 is a cross-sectional view taken generally along the line 4—4 of FIG. 3.
Figure 5:
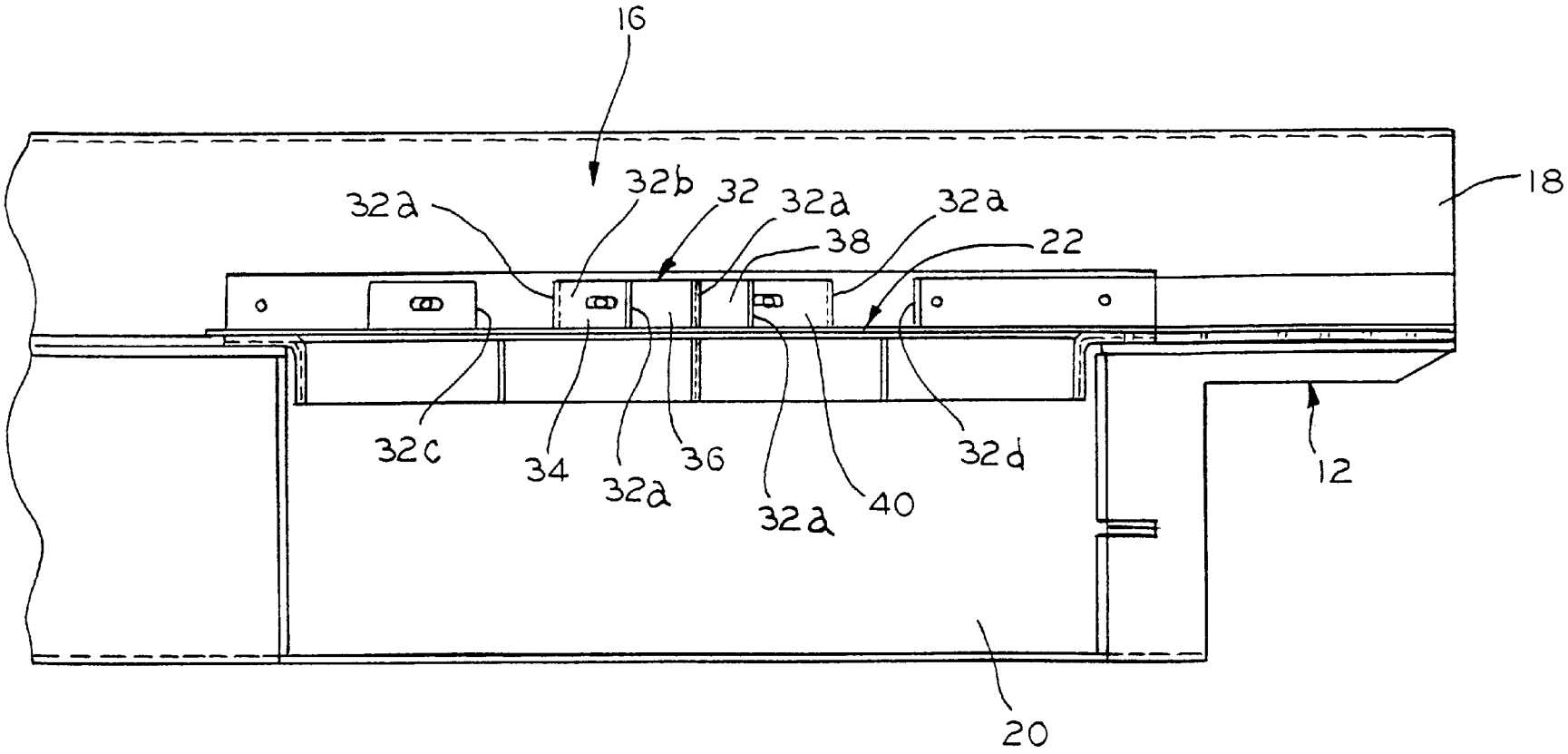
FIG. 5 is a cross-sectional view taken generally along the line 5—5 of FIG. 3.

As shown in FIGS. 3–5, the stabilizing means comprises a grate 32 on an upper surface 22*a* of the fluidizing deck 22 having at least a plurality of material retention walls 32*a* that are preferably vertically upstanding. The material retention walls 32*a* extend across, and preferably generally transversely of, the material separation section 16 in preferably longitudinally spaced relation to define a plurality of stable fluidizing zones such as 34 through 40. For structural purposes, the grate 32 may also include vertically upstanding support walls 32*b* extending generally in the direction of material flow through the material separation section 16.

As also shown in FIGS. 3 and 5, the material separation section may advantageously include an upstream weir 32*c* and a downstream weir 32*d* defining additional stable fluidizing zones immediately upstream and downstream of the grate 32, respectively. The upstream and downstream weirs 32*c* and 32*d* may suitably be made adjustable, as shown, in order to adjust the size of the fluidizing zones defined thereby. By so doing, it is possible to vary the effective area of the fluidizing deck 22 between limits determined by the degree of adjustability that may be achieved by moving the upstream and downstream weirs 32*c* and 32*d* longitudinally toward and away from each other.

Figure 2:
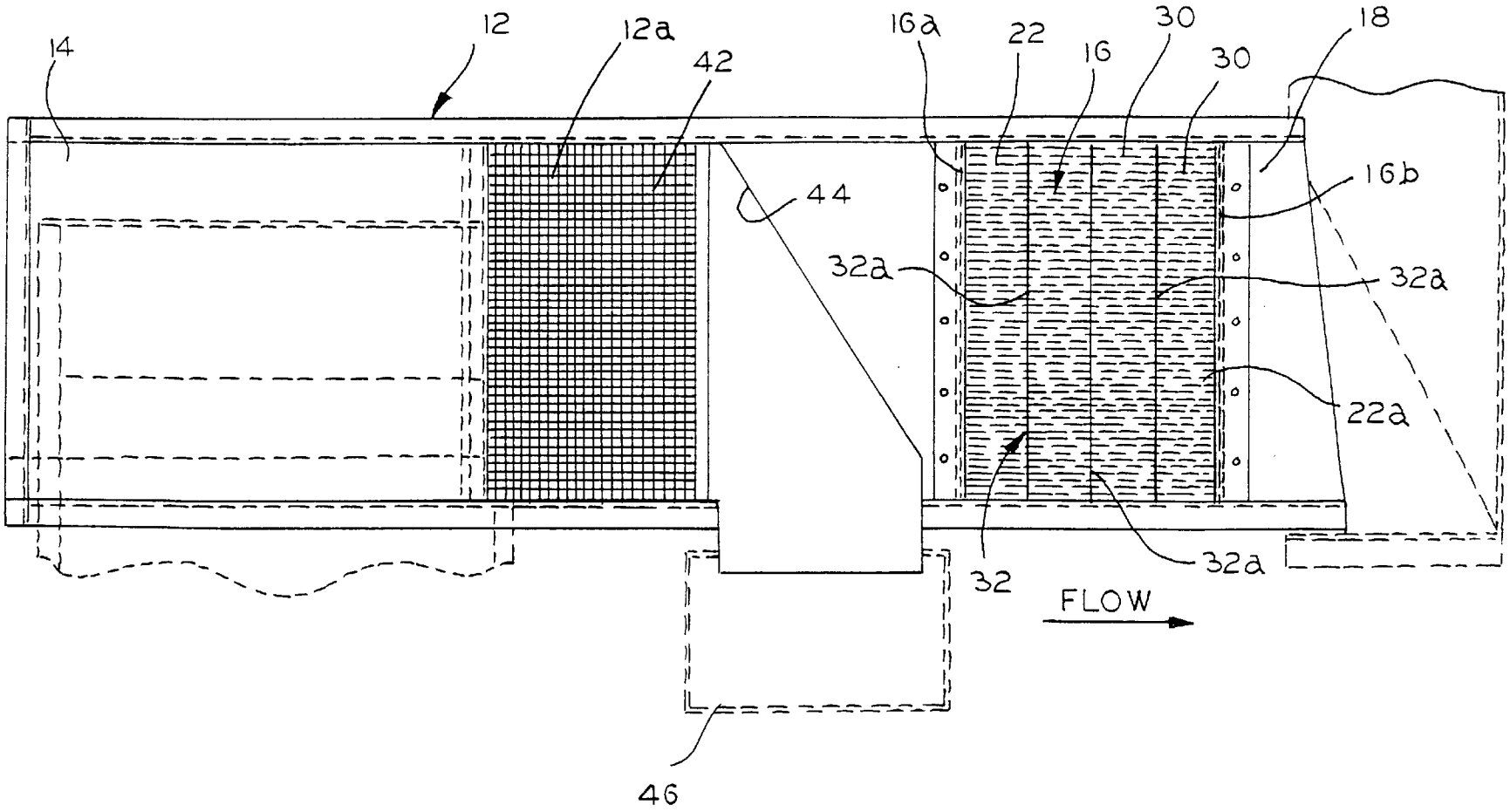
FIG. 2 is a plan view of the portion of the material classifying apparatus illustrated in FIG. 1.

As shown in FIG. 2, the vibratory conveyor 12 may also include a screen section 42 upstream of the material separation section 16 having a mesh size to permit the heavier material in the form of shot as well as the lighter fines to pass from a first level 12*a* of the vibratory conveyor 12 through the screen section 42 to a second, lower level 12*b* while retaining any overs material larger than the heavier material at the first level 12*a*. It will be appreciated, for instance, that where the material classifying apparatus 10 is utilized to separate fines and dust from shot the screen section 42 will serve to separate the shot and fines and dust from any larger overs material such as large portions of a sand mold or sand core, or a casting that might somehow reach the vibratory conveyor 12. As shown in FIG. 2, an overs material diverting wall 44 is provided downstream of the screen section 42 of the vibratory conveyor 12 at the first level 12*a* and upstream of the material separation section 16 in order to cause overs material to be diverted from the vibratory conveyor 12 to an overs material collection box 46 positioned alongside the vibratory conveyor 12.

Referring to FIGS. 6 and 7, the closed loop air circulation system 24 includes an exhaust hood 48 positioned above the material separation section 16 of the vibratory conveyor 12. The closed loop air circulation system 24 also includes means defining a continuous air flow path extending from the exhaust hood 48 back to the plenum chamber 20 and, more specifically, it includes an air duct 50 flexibly connected as at 52 to the exhaust hood 48 and extending therefrom and an air duct 54 extending toward the plenum 20 and flexibly connected thereto as at 56. Still additionally, the closed loop air circulation system 24 includes an air blower 58 to circulate air from the exhaust hood 48, through the air duct 50, through the air duct 54, and back to the plenum chamber 20.

As also shown in FIG. 6, the closed loop air circulation system 24 includes means for removing fines along the continuous air flow path at a point upstream of the plenum chamber 20. The fines removing means includes a cyclone separator 60 for removing fines and dust or other refuse that has been separated from the heavier material in the material separation section 16 and also includes a dust collector 62 downstream of the cyclone separator 60 for removing dust, i.e., the fines are removed by the cyclone separator 60 and the dust is removed by the dust collector 62 so that clean air will be supplied to the plenum chamber 20. In other words, the cyclone separator 60 and the dust collector 62 are both positioned for removing the fines and dust upstream of the plenum chamber 20 and, preferably, upstream of the blower 58.

Still referring to FIG. 6, the closed loop air circulation system 24 may include an inlet air diffuser or screen 64 at the upstream end 20*a* of the plenum chamber 20 to provide uniformly distributed air to the material separation section 16 of the vibratory conveyor 12. It will also be seen in FIG. 1 that the exhaust hood 48 may be provided with a pair of adjustable plates 66 and 68 defining an airflow path above the material separation section 16 to control air flow velocity through the exhaust hood 48. As previously described, the apparatus 10 also preferably includes a first flexible seal 26 at an upstream end 16*a* of the material separation section 16 and a second flexible seal 28 at a downstream end of the material separation section 16 as part of the closed loop air circulation system 24.

From the foregoing, it will be clear that the material classifying apparatus 10 is particularly well suited for separating fines as well as dust from shot in a continuous process that is highly effective and cost efficient. The vibratory conveyor 12 conveys shot and fines that are deposited through a feeder 70 that leads from a shot blast apparatus. The vibratory conveyor 12 conveys these materials at a first level 12*a* where they fall through the screen section 42 to a second level 12*b* at which they are conveyed through the material separation section 16. If there are any overs materials larger than the shot at the first level 12*a*, they are diverted from the vibratory conveyor 12 by the overs material diverting wall 44 to the overs material collection box 46 alongside the vibratory conveyor 12.

As the shot and fines reach the material separation section 16, they entirely fill the grate 32, i.e., they fill the plurality of stable, uniform airflow fluidizing zones such as 34 through 40. The fact that the stable, uniform airflow fluidizing zones such as 34 through 40 are present immediately above the plenum chamber 20 means that the air from the plenum chamber 20 that has passed through the diffuser 64 is uniformly distributed and passes through the material that is temporarily captured within the fluidizing zones which material serves to further uniformly disperse the air to cause a uniform fluidization of the material above the grate 32 and especially above the material retention walls 32*a* that is continuing to flow toward the outlet end 18 of the vibratory conveyor 12. As a result, the fluidizing air causes the fines and dust to be blown upwardly out of the shot where it passes through the exhaust hood 48, the air duct 50, and into the cyclone separator 60.

In the cyclone separator 60, the heavier fines are removed while air containing dust continues to flow into the dust collector 62 where the dust is removed leaving only clean air to flow to the blower 58 and then through the air duct 54 into the plenum chamber 20. In this manner, the closed loop air circulation system 24 combined with the grate 32 produces the intended effect of removing the fines and dust due to the stable, uniform airflow fluidizing zones such as 34 through 40 produced by the shot that is temporarily retained therewithin.

While the invention has been specifically defined in connection with separating lighter fines from a heavier material, and even more specifically in connection with separating fines and dust from shot, it will be appreciated that it has much broader applications. In fact, the present invention may find use wherever it is desired to separate two classifiable materials, whether those materials are classified, e.g., as having different terminal velocities as heavier material and lighter fines, as shot and fines and dust, or otherwise. If one of the materials is capable of being fluidized and the other of the materials is capable of being separated therefrom through the action of the fluidizing air, the present invention can be advantageously utilized to achieve a substantially complete material separation and classification.

While in the foregoing there has been set forth a preferred embodiment of the invention, it will be appreciated that the details herein given may be varied by those skilled in the art without departing from the true spirit and scope of the appended claims.

We claim:

1. A material classifying apparatus, comprising:

a vibratory conveyor for conveying two classifiable materials from an inlet end through a material separation section to an outlet end located downstream of said material separation section of said vibratory conveyor;

a source of air for generating an air flow;

a plenum chamber in fluid communication with the source of air, the plenum chamber directing said air flow upwardly through the two classifiable materials in said material separation section of said vibratory conveyor to cause fluidization of one of the materials and separation of the other of the materials therefrom;

said material separation section of said vibratory conveyor including a fluidizing deck for supporting the materials while accommodating passage of air upwardly through the fluidized one of the materials; and means for stabilizing the fluidized one of the materials on said fluidizing deck to produce a controlled air flow through the fluidized one of the materials to facilitate separation of the other of the materials therefrom upstream of said outlet end of said vibratory conveyor.

2. The material classifying apparatus of claim 1 wherein said plenum chamber and said material separation section define a portion of a closed loop air circulation system and including means for isolating said material separation section from the remainder of said vibratory conveyor to maintain a desired air pressure within said closed loop air circulation system.

3. The material classifying apparatus of claim 1 wherein said fluidizing deck has a plurality of air passageways within a closed loop air circulation system to permit air to continuously flow from said plenum chamber through said air passageways in said fluidizing deck and back to said plenum chamber to fluidize the fluidized one of the materials and separate the other of the materials therefrom.

4. The material classifying apparatus of claim 1 wherein said stabilizing means comprises a grate on an upper surface of said fluidizing deck and having at least a plurality of material retention walls extending generally across said material separation section in spaced relation to define a plurality of stable fluidizing zones.

5. The material classifying apparatus of claim 1 including an exhaust hood above said material separation section of said vibratory conveyor which together with said plenum chamber forms a portion of a closed loop air circulation system for fluidizing the fluidized one of the materials and separating the other of the materials therefrom for removal through said exhaust hood.

6. A material classifying apparatus for separating lighter material from heavier material, comprising:

a vibratory conveyor for conveying heavier material containing lighter material from an inlet end through a material separation section to an outlet end located downstream of said material separation section of said vibratory conveyor;

a source of air for generating an air flow;

a plenum chamber in fluid communication with the source of air the plenum chamber directing said air flow upwardly through the heavier material and the lighter material in said material separation section of said vibratory conveyor to cause fluidization of the heavier material and separation of the lighter material therefrom;

said plenum chamber and said material separation section defining a portion of a closed loop air circulation system and including means for isolating said material separation section from the remainder of said vibratory conveyor to maintain a desired air pressure therewithin;

said material separation section of said vibratory conveyor including a fluidizing deck for supporting the heavier material and the lighter material while accommodating passage of air upwardly from said plenum chamber through the heavier material; and a grate on an upper surface of said fluidizing deck having a plurality of vertically upstanding material retention walls extending generally transversely of said vibratory conveyor in longitudinally spaced relation to form a plurality of stable, uniform air flow fluidizing zones for separation and removal of the lighter material from the heavier material through the closed loop air circulation system upstream of said outlet end of said vibratory conveyor.

7. The material classifying apparatus of claim 6 wherein said fluidizing deck has multiple air passageways to permit air to continuously flow through said closed loop air circulation system from said plenum chamber through said fluidizing deck and back to said plenum chamber to continuously fluidize the heavier material and separate the lighter material therefrom.

8. The material classifying apparatus of claim 6 including an exhaust hood above said material separation section of said vibratory conveyor which together with said plenum chamber forms a portion of said closed loop air circulation system for fluidizing the heavier material to thereby separate the lighter material for removal through said exhaust hood.

9. The material classifying apparatus of claim 6 wherein said vibratory conveyor includes a screen section upstream of said material separation section having a mesh size to permit the heavier material and lighter material to pass from a first level of said vibratory conveyor to a second, lower level while retaining any overs material larger than the heavier material at the first level.

10. The material classifying apparatus of claim 9 including an overs material diverting wall downstream of said screen section of said vibratory conveyor at said first level and upstream of said material separation section to cause overs material to be diverted from said vibratory conveyor to an overs material collection box alongside said vibratory conveyor.

11. The material classifying apparatus of claim 6 wherein said closed loop air circulation system includes an exhaust hood above said material separation section of said vibratory conveyor, means defining a continuous air flow path from said exhaust hood to said plenum chamber, and means for removing the lighter material along said continuous air flow path.

12. A material classifying apparatus for separating lighter fines from heavier shot, comprising:

a vibratory conveyor for conveying heavier shot containing lighter fines from an inlet end through a material separation section to an outlet end located downstream of said material separation section of said vibratory conveyor;

a source of air for generating an air flow;

a plenum chamber in fluid communication with the source of air, the plenum chamber directing said air flow upwardly through the heavier shot and the lighter fines in said material separation section of said vibratory conveyor to cause fluidization of the heavier shot and separation of the lighter fines therefrom;

said plenum chamber and said material separation section defining a portion of a closed loop air circulation system and including means for isolating said material separation section from the remainder of said vibratory conveyor to maintain a desired air pressure therewithin;

said material separation section of said vibratory conveyor including a fluidizing deck for supporting the heavier shot and the lighter fines while accommodating passage of air upwardly from said plenum chamber through the heavier shot, said fluidizing deck having multiple air passageways to permit air to continuously flow through said closed loop air circulation system to continuously fluidize the heavier shot and separate the lighter fines therefrom; and a grate on an upper surface of said fluidizing deck having a plurality of vertically upstanding material retention walls extending generally transversely of said vibratory conveyor in longitudinally spaced relation to form a plurality of stable, uniform air flow fluidizing zones for separation and removal of the lighter fines from the heavier shot through the closed loop air circulation system upstream of said outlet end of said vibratory conveyor said;

closed loop air circulation system including an exhaust hood above said material separation section of said vibratory conveyor, means defining a continuous air flow path extending from said exhaust hood back to said plenum chamber, and means for removing the lighter material along said continuous air flow path at a point upstream of said plenum chamber.

13. The material classifying apparatus of claim 12 wherein said vibratory conveyor includes a screen section upstream of said material separation section having a mesh size to permit the heavier shot and lighter fines to pass from a first level of said vibratory conveyor to a second lower level while retaining any overs material larger than the heavier shot at the first level.

14. The material classifying apparatus of claim 13 including an overs material diverting wall downstream of said screen section of said vibratory conveyor at said first level and upstream of said material separation section to cause overs material to be diverted from said vibratory conveyor to an overs material collection box alongside said vibratory conveyor.

15. The material classifying apparatus of claim 12 wherein said continuous air flow path defining means includes an air duct flexibly connected to said exhaust hood and extending therefrom and an air duct extending toward said plenum chamber and flexibly connected thereto and including an air blower for circulating air from said exhaust hood to said plenum chamber.

16. The material classifying apparatus of claim 12 wherein said lighter material removing means includes a cyclone separator downstream of said exhaust hood for removing the lighter fines from said closed loop air circulation system upstream of said plenum chamber.

17. The material classifying apparatus of claim 16 wherein said lighter material removing means further includes a dust collector downstream of said cyclone separator for removing dust from said closed loop air circulation system upstream of said plenum chamber.

18. The material classifying apparatus of claim 12 wherein said closed loop air circulation system includes an inlet air diffuser at the upstream end of said plenum chamber to provide uniformly distributed air to said material separation section of said vibratory conveyor.

19. The material classifying apparatus of claim 12 wherein said exhaust hood includes a pair of adjustable plates defining an air flow path above said material separation section to control air flow velocity through said exhaust hood.

20. The material classifying apparatus of claim 12 wherein said isolating means includes a first seal at an upstream end of said material separation section and a second seal at a downstream end of said material separation section.

* * * * *